US008690302B2

(12) United States Patent
Paschkewitz et al.

(10) Patent No.: US 8,690,302 B2
(45) Date of Patent: Apr. 8, 2014

(54) BUBBLE REMOVAL FOR INK JET PRINTING

(75) Inventors: John Steven Paschkewitz, San Carlos, CA (US); Eric J. Shrader, Belmont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 415 days.

(21) Appl. No.: 12/961,148

(22) Filed: Dec. 6, 2010

(65) Prior Publication Data

US 2012/0140004 A1 Jun. 7, 2012

(51) Int. Cl.
*B41J 2/19* (2006.01)
*B41J 2/175* (2006.01)

(52) U.S. Cl.
USPC ..... 347/92; 347/85

(58) Field of Classification Search
USPC ..... 347/84, 85, 86, 92
See application file for complete search history.

(56) References Cited

U.S. PATENT DOCUMENTS

| | | | |
|---|---|---|---|
| 4,476,472 | A | 10/1984 | Aiba et al. |
| 4,788,556 | A | 11/1988 | Hoisington et al. |
| 4,995,940 | A | 2/1991 | Hine et al. |
| 5,030,973 | A | 7/1991 | Nonoyama et al. |
| 5,107,281 | A | 4/1992 | Takahashi |
| 5,219,020 | A | 6/1993 | Akachi |
| 5,527,588 | A | 6/1996 | Camarda et al. |
| 5,701,148 | A | 12/1997 | Moynihan et al. |
| 6,257,714 | B1 | 7/2001 | Seccombe |
| 6,398,850 | B1 | 6/2002 | Field et al. |
| 6,457,821 | B1 | 10/2002 | Liu et al. |
| 6,863,118 | B1 | 3/2005 | Wang et al. |
| 7,201,476 | B2 | 4/2007 | Buchanan et al. |
| 7,273,275 | B2 | 9/2007 | Buchanan et al. |
| 2002/0186283 | A1 | 12/2002 | Smith et al. |
| 2005/0185030 | A1 | 8/2005 | Hoisington et al. |
| 2007/0144967 | A1 | 6/2007 | Guenther et al. |

OTHER PUBLICATIONS

Korol, "An Analysis of Recent Advances in Solid Ink Printer Performance from a Print Head Perspective", NIP24 and Digital Fabrication, 2008, pp. 107-112.

EP Search Report and Written Opinion dated Mar. 29, 2012 from EP Application No. 11191280.4, 7 pages.

*Primary Examiner* — Jannelle M Lebron

(74) *Attorney, Agent, or Firm* — Hollingsworth Davis, LLC

(57) ABSTRACT

Approaches to remove bubbles from ink in an ink jet printer are described. Bubble removal may be implemented using one or more separator elements configured to separate bubbles of a vapor from ink. Each separator element includes wicking features having dimensions sufficient to allow capillary movement of the ink in the wicking features and to substantially exclude the bubbles from the wicking features. One or more inlets allow passage of the ink that includes the bubbles into the separator element. At least one vapor outlet allows vapor that has been separated from the ink to exit from the separator element. The ink exits from the separator element thought one or more ink outlets.

25 Claims, 12 Drawing Sheets

BUBBLE REMOVAL FOR INK JET PRINTING

FIELD

The present disclosure relates generally to methods and devices useful for ink jet printing.

SUMMARY

Embodiments discussed in the disclosure are directed to methods and devices used in ink jet printing.

Some embodiments involve an ink jet print head subassembly. The subassembly includes one or more separator elements configured to separate bubbles of a vapor from ink. Each separator element comprises wicking features having dimensions sufficient to allow capillary movement of the ink in the wicking features and to substantially exclude the bubbles of the vapor from the wicking features. One or more inlets are configured to allow passage of the ink that includes the bubbles of the vapor into the separator element. At least one vapor outlet is configured to allow the vapor that has been separated from the ink to exit from the separator element. One or more ink outlets configured to allow the ink to exit from the separator element.

According to various aspects of the print head subassembly, each ink outlet is dimensioned so that a pressure gradient required for entry of the bubbles into the ink outlet is greater than a pressure gradient required for entry of the bubbles into the vapor outlet. The wicking features have a radius of curvature about an order of magnitude less than a radius of curvature of an ink jet. The inlet has a radius of curvature greater than a radius of curvature of the wicking features. The separator element includes a vapor region configured to allow movement of the vapor within the separator element, and, the ink moves primarily in the wicking features of the separator element to the ink outlets and the vapor moves primarily in the vapor region to the vapor outlet. The vapor outlet and the ink outlets are dimensioned to provide a path of least resistance for the vapor.

The subassembly may have various shapes, such as a triangular shape or a star shape. The corners of the shape form the wicking features and a center portion of the shape forms the vapor passage. In some cases each of the wicking features comprises at least one angle of less than about 45 degrees.

The subassembly may be formed as a layered structure including: an inlet layer that includes the inlet; an outlet layer that includes the vapor outlet and the ink outlets; and a separator layer that includes the separator element, the separator layer disposed between the inlet layer and the outlet layer.

In some cases, the subassembly can include multiple separator elements, each separator element fluidically coupled to corresponding inlet passages, ink outlet passages and vapor passages.

Some embodiments involve methods for separating bubbles from ink. According to some methods, ink that includes bubbles moves into a separator element of an ink jet print head, the separator element including a central region and wicking features. The ink is separated from the bubbles of vapor in the separator element, wherein separating the ink includes moving the ink in the wicking features by capillary action, wherein the bubbles are substantially excluded from the wicking features. The vapor passes through the central portion of the separator element towards a vapor outlet. The ink moves from the separator element to ink jets of an ink jet print head. The ink that exits the separator element to the ink jets includes fewer bubbles of the vapor than the ink that enters the separator element. The ink is ejected from the inkjets onto print media.

Separating the ink from the bubbles of vapor depends on pressures within the separator element which are sufficient to allow the ink to enter ink outlets and to substantially prevent the ink from entering the vapor outlet. Separating the ink from the bubbles of vapor depends on hydrodynamic resistances within the separator element which are sufficient to prevent the bubbles from entering the wicking features and to allow the bubbles to enter the vapor outlet.

Some embodiments are directed to a layered structure. The layered structure includes an inlet layer configured to form inlets for ink that includes bubbles of a vapor. An outlet layer is configured to form a vapor outlet that allows passage of the vapor which has been separated from the ink and to form one or more ink outlets that allow passage of ink. A separator layer disposed between the inlet layer and the outlet layer. The separator layer comprises a separator element that includes wicking features configured to separate the ink from the bubbles of the vapor. The wicking features are dimensioned to allow entry of the ink into the wicking features and to transport the ink through capillary action and to substantially exclude the bubbles from the wicking features.

According to various aspects of the layered structure, the wicking features have a radius of curvature about an order of magnitude less than a radius of curvature of an ink jet. The inlet has a radius of curvature greater than a radius of curvature of the wicking features. The separator element includes a vapor region configured to allow movement of the vapor within the separator element, and, the ink moves primarily in the wicking features of the separator element to the ink outlets and the vapor moves primarily in the vapor region to the vapor outlet. The separator element may have a triangular or star shape and corners of the triangular or star shape form the wicking features and a center portion of the triangular or star shape forms the vapor passage.

Some embodiments involve a method of making a bubble separator for an ink jet printer. The methods may include forming an inlet layer, the inlet layer including at least one inlet configured to contain ink that includes bubbles of a vapor. An outlet layer is formed that includes at least one vapor outlet configured to allow passage of the vapor which has been separated from the ink and one or more ink outlets. A separator layer is formed that is disposed between the inlet layer and the outlet layer. The separator layer comprises a separator element that includes wicking features configured to separate the ink from the bubbles of the vapor. The wicking features are dimensioned to allow entry of the ink into the wicking features and to transport the ink through capillary action and to substantially exclude the bubbles from the wicking features. The separator layer is attached between the inlet layer and the outlet layer.

Forming one or more of the inlet layer, outlet layer and separator layer may comprise one or more of chemical etching, laser cutting, punching, machining, and printing. Attaching the separator layer between the inlet layer and the outlet layer may comprise one or more of diffusion bonding, plasma bonding, adhesives, welding, chemical bonding, and mechanical joining.

Some embodiments involve an ink jet printer. The ink jet printer includes a print head comprising jets configured to selectively eject ink toward a print media according to predetermined pattern. A transport mechanism is configured to provide relative movement between the print media and the print head. A bubble separator is configured to separate bubbles of vapor from the ink before the ink enters the jets.

The bubble separator includes: a separator element comprising wicking features having dimensions sufficient to allow capillary movement of the ink in the wicking features and to substantially exclude the bubbles of the vapor from the wicking features; one or more inlet passages configured to allow passage of the ink that includes the bubbles of the vapor into the separator element; at least one vapor outlet passage configured to allow exit of the vapor that has been separated from the ink from the separator element; and one or more ink outlet passages configured to allow the ink to exit from the separator element.

According to various aspects of the ink jet printer, the wicking features can have a radius of curvature about an order of magnitude less than a radius of curvature of an ink jet. The inlet can have a radius of curvature greater than a radius of curvature of the wicking features. The separator element can include a vapor region configured to allow movement of the vapor within the separator element, wherein the ink moves primarily in the wicking features of the separator element to the ink outlets and the vapor moves primarily in the vapor region to the vapor outlet.

Some embodiments involve an ink jet print head subassembly that includes a means for separating bubbles of a vapor from an ink. One or more inlet passages are configured to allow passage of the ink that includes the bubbles of the vapor into the means for separating. At least one vapor outlet passage is configured to allow the vapor that has been separated from the ink to exit from the means for separating. One or more ink outlet passages are configured to allow the ink to exit from the means for separating.

DESCRIPTION OF VARIOUS EMBODIMENTS

Figure 1:
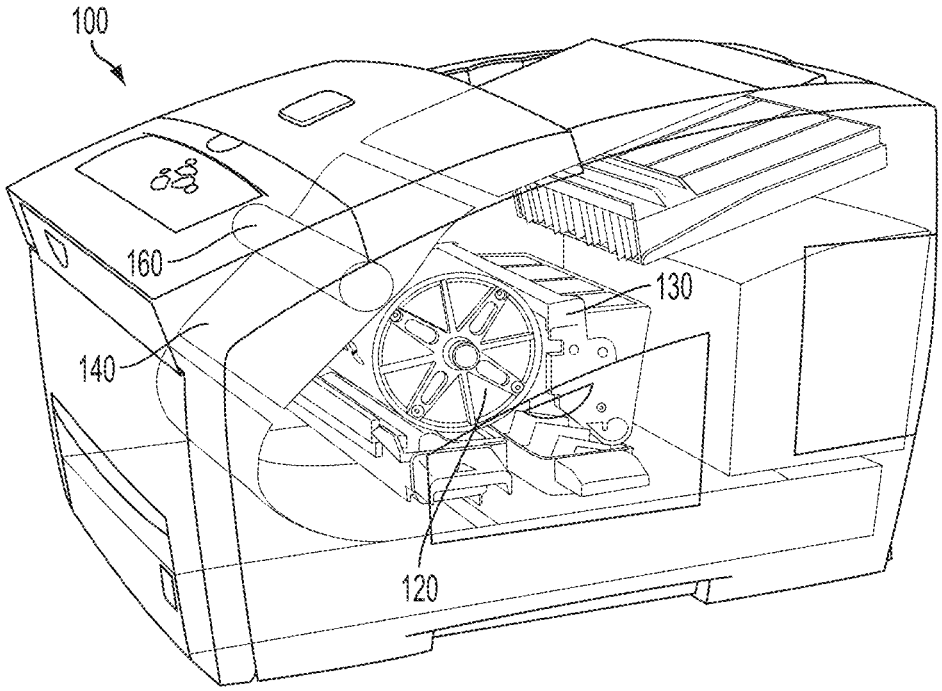
FIGS. 1 and 2 provide internal views of portions of an ink jet printer 100 that incorporates a bubble separator.

Ink jet printers operate by ejecting small droplets of liquid ink onto print media according to a predetermined pattern. In some implementations, the ink is ejected directly on a final print media, such as paper. In some implementations, the ink is ejected on an intermediate print media, e.g. a print drum, and is then transferred from the intermediate print media to the final print media. Some ink jet printers use cartridges of liquid ink to supply the ink jets. Solid ink printers have the capability of using a phase change ink which is solid at room temperature and is melted before being jetted onto the print media surface Inks that are solid at room temperature advantageously allow the ink to be transported and loaded into the ink jet printer in solid form, without the packaging or cartridges typically used for liquid inks In some implementations, the solid ink is melted in a page-width print head which jets the molten ink in a page-width pattern onto an intermediate drum. The pattern on the intermediate drum is transferred onto paper through a pressure nip.

In the liquid state, ink may contain bubbles and/or particles that can obstruct the passages of the ink jet pathways. For example, bubbles can form in solid ink printers due to the freeze-melt cycles of the ink that occur as the ink freezes when printer is powered down and melts when the printer is powered up for use. As the ink freezes to a solid, it contracts, forming voids in the ink that are subsequently filled by air. When the solid ink melts prior to ink jetting, the air in the voids can become bubbles in the liquid ink.

Bubbles in the ink jet pathways can cause misplaced, intermittent, missing or weak ink jetting resulting in undesirable visual flaws in the final printed pattern. Some ink jet printers pass the ink through filters, flow breathers, buoyancy-based bubble separators or other devices to prevent bubbles and/or particles from reaching the jet region of the print head. However, these techniques present several problems. Filtering is non-optimal because filters can become clogged over the operational life of the printer. Significant engineering is required to ensure that coalesced bubbles do not clog the filter. Additionally, filter elements block the ink flow to some extent and induce a pressure drop penalty that may be undesirable in print head operation. This pressure drop is exacerbated as the filter surface becomes covered with bubbles and/or particles that have been filtered from the ink. Flow breathers have been used to remove bubbles, but add complexity to the print head design. Devices that rely on the buoyancy of bubbles increase the bulk of the print head. The characteristic rise velocities of small bubbles, i.e., on the scale of the print head orifices, are very small and the resulting separation times can be large. As a result, dedicated volumes are required for the separator elements, increasing print head size.

Embodiments described in this disclosure involve approaches for removing bubbles from the ink of an ink jet printer. The approaches involve the use of wicking features that provide capillary wicking of the ink into a separate flow path from the path of the vapor from the bubbles. The wicking features used in conjunction with other features of the bubble separator described herein are dimensioned to control hydrodynamic resistances within the print head to provide a preferred flow path for the vapor from the bubbles that is separate from the ink flow path.

Figure 2:
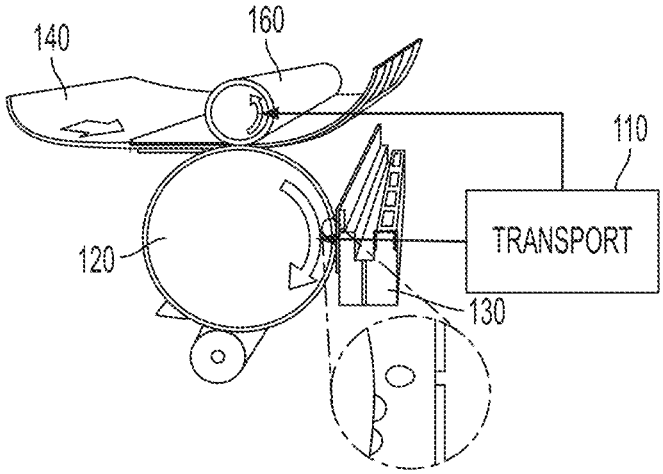

FIGS. 1 and 2 provide internal views of portions of an ink jet printer 100 that incorporates a bubble separator as discussed herein. The printer 100 includes a transport mechanism 110 that is configured to move the drum 120 relative to the print head 130 and to move the paper 140 relative to the drum 120. The print head 130 may extend fully or partially along the length of the drum 120 and includes a number of ink jets. As the drum 120 is rotated by the transport mechanism 110, ink jets of the print head 130 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
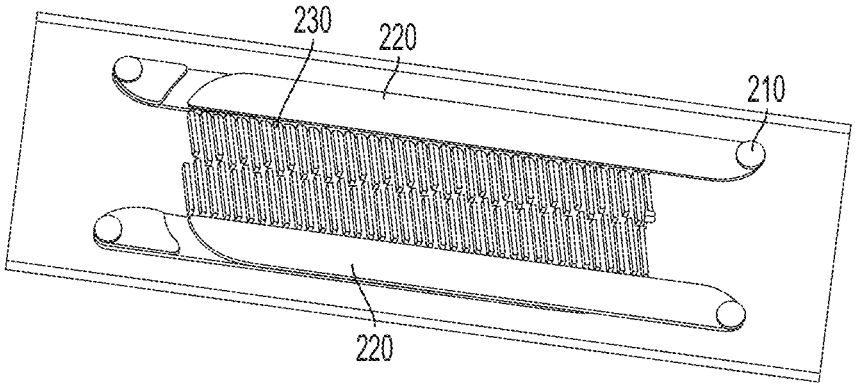
FIGS. 3 and 4 show views of an exemplary print head.
Figure 4:
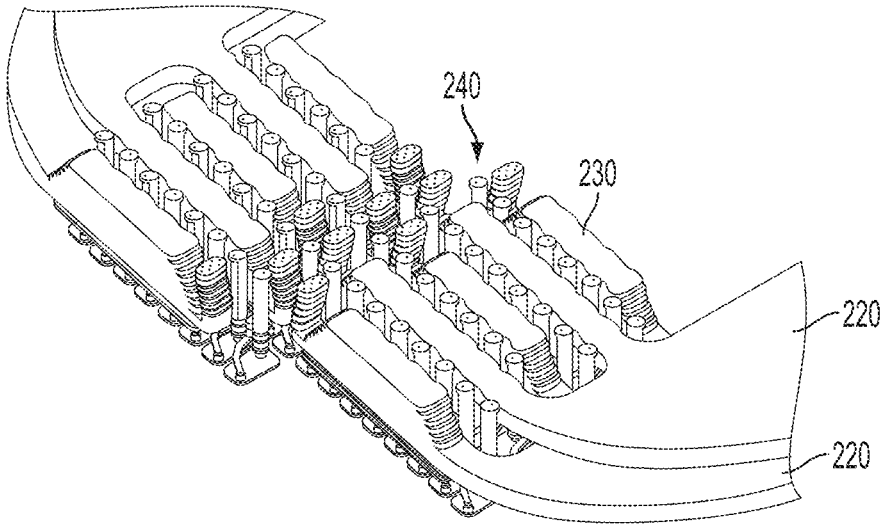

FIGS. 3 and 4 show more detailed views of an exemplary print head. The path of molten ink, contained initially in a reservoir, flows through a port 210 into a main manifold 220 of the print head. As best seen in FIG. 4, in some cases, there are four main manifolds 220 which are overlaid, one manifold 220 per ink color, and each of these manifolds 220 connects to interwoven finger manifolds 230. The ink passes through the finger manifolds 230 and then into the ink jets 240. The manifold and ink jet geometry illustrated in FIG. 4 is repeated to achieve a desired print head length, e.g. the full width of the drum.

Figure 5:
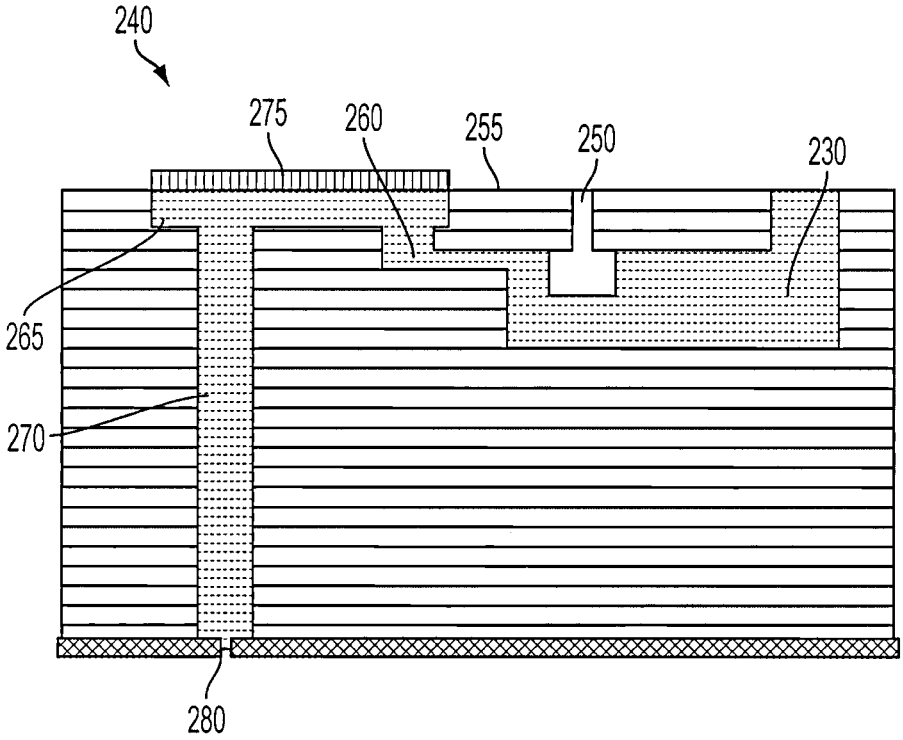
FIG. 5 provides a view of a finger manifold and ink jet which shows a possible location for the bubble separator near the ink jet inlet between the finger manifold and the ink jet body.

In some examples discussed in this disclosure, the print head uses piezoelectric transducers (PZTs) for ink droplet ejection, although other methods of ink droplet ejection are known and such printers may also use a bubble separator as described herein. FIG. 5 provides a more detailed view of a finger manifold 230 and ink jet 240 which shows a possible location for the bubble separator 250 in the finger manifold 230. The bubble separator 250 may be located elsewhere, such as the main manifold, for example. The print head may include multiple bubble separators positioned at one or more locations.

Activation of the PZT 275 causes a pumping action that alternatively draws ink into the ink jet body 265 and expels the ink through ink jet outlet 270 and aperture 280. As the ink moves through the separator 250, bubbles of vapor present in the ink are separated from the liquid ink and exit through the vent 255. The bubble separator 250 uses microscale features that provide hydrodynamic resistance control and capillary wicking to remove bubbles from the liquid stream of ink in a continuous manner as the ink flows into the ink jet body 265. The liquid ink preferentially wicks through the wicking features of the separator 250 while the vapor is channeled to the vapor vent 255.

Figure 6:
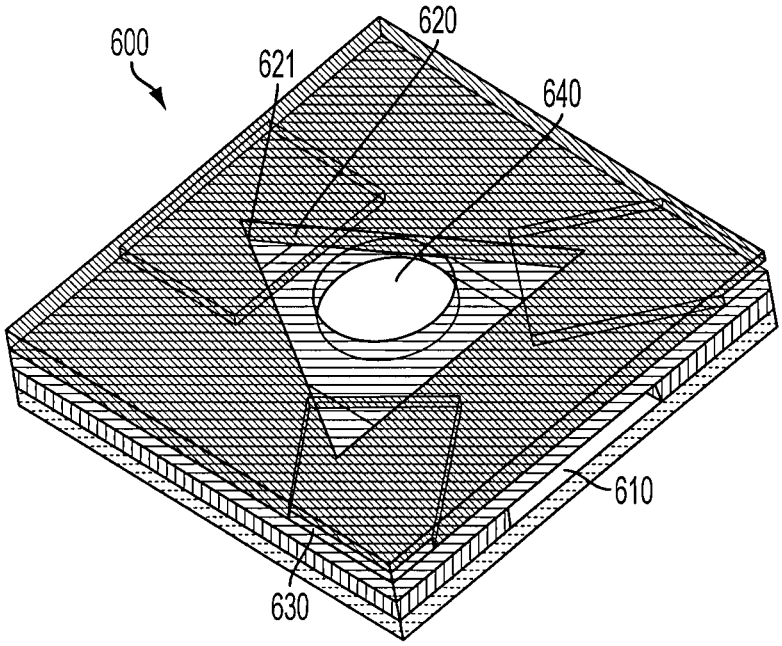
FIGS. 6 and 7 illustrate isometric and cutaway views, respectively, of a bubble separator.
Figure 7:
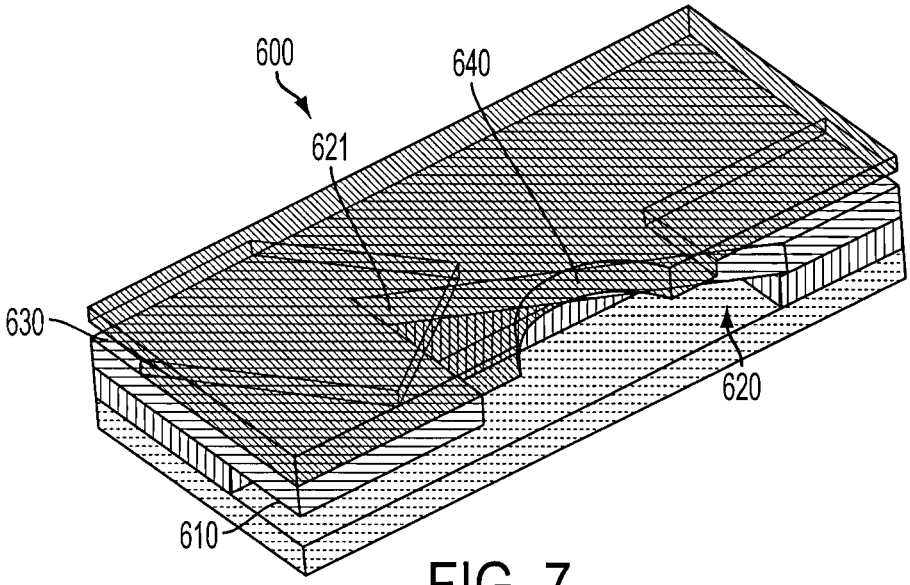

FIGS. 6 and 7 illustrate isometric and cutaway views, respectively, of the bubble separator 600 according to one configuration. The bubble separator 600 includes one or more inlets 610 that allow passage of ink that includes bubbles of vapor to enter the bubble separator 600. The separator element 620 within the bubble separator 600 includes one or more wicking features 621 that have dimensions sufficient to allow capillary movement of the ink within the wicking features 621 and to substantially exclude the bubbles from the wicking features 621. In the example illustrated in FIGS. 6 and 7, the separator element 620 includes a triangular feature. The wicking features 621 are the corners of the triangular feature. The bubble separator 600 further includes one or more ink outlets 630 fluidically coupled to the wicking features 621. The ink outlets 630 allow ink to exit the bubble separator 600 whereas the vapor from the bubbles exits through vapor outlet 640 in the center of the triangular feature.

Optionally in conjunction with wicking features 621 that provide capillary wicking of the ink, additional features may be disposed within the bubble separator 600 that provide a preferential flow path for the bubbles. The hydrodynamic resistances within the bubble separator 600 are designed so that the pressure gradient required for the bubbles to follow the flow path of the ink is greater than the pressure gradient required for the bubbles to bypass the ink flow path. For example, in some cases, the dimensions of the wicking features 621, the ink outlets 630, and/or the vapor outlet 640 can be selected so that the hydrodynamic resistances of the wicking features 621, ink outlets 630 and/or the vapor outlet 640 provide a preferred path for the bubbles to bypass the wicking features 621 and the ink outlets 630 and the to exit the separator 600 through the vapor outlet 640.

Although the wicking features illustrated in FIGS. 6 and 7 are depicted as corners of a triangular separator element, the wicking features may have any angled or rounded cross sectional shape that can be dimensioned to provide ink wicking that substantially excludes bubbles. FIGS. 8-19 depict various exemplary configurations of the separator element and wicking features, although many other configurations are possible.

Figure 8:
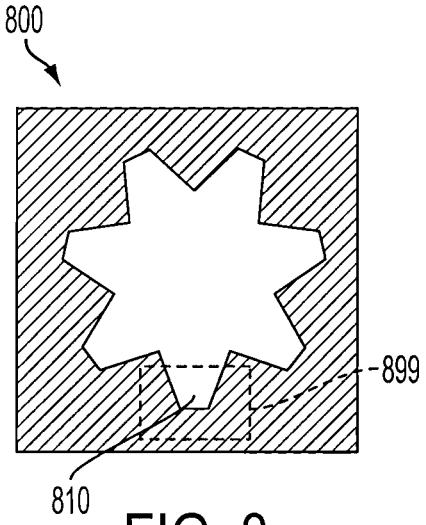
FIGS. 8-19 depict various exemplary configurations of the separator element and wicking features.
Figure 9:
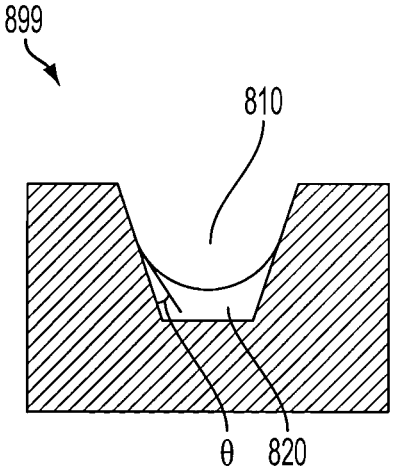
Figure 10:
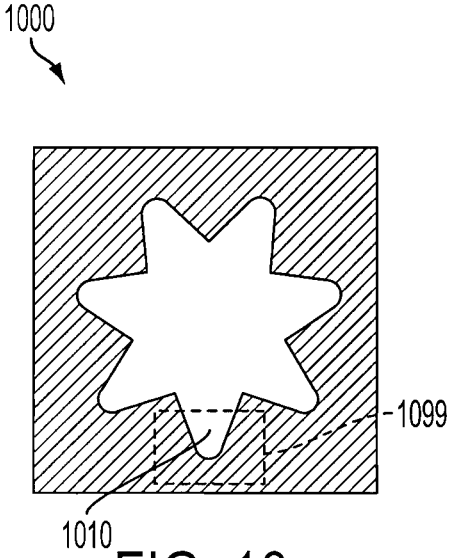
Figure 11:
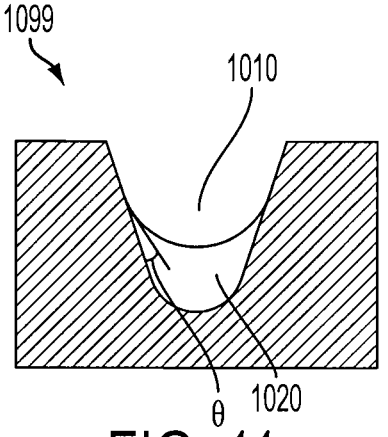

Whether ink will wick into the wicking features is dependent on the shape of the wicking features, the fluid properties of the ink, and/or the materials of construction of the print head, among other properties. The contact angle, $\theta$, of the liquid, which is a parameter dependent on the fluid properties of the ink and the composition and configuration of the wicking surface, e.g. microstructure topology of the surface, is determinative of whether wicking will occur. The contact angle is the angle of incidence that is formed between the solid surface of wicking feature and the ink. FIGS. 8 and 10 illustrate two configurations of separator elements 800, 1000 that include angled (FIG. 8), and rounded (FIG. 10) wicking features 810, 1010. FIG. 9 shows a portion 899 of the separator element 800 of FIG. 8 including wicking feature 810. FIG. 11 shows a portion 1099 of the separator element 1000 of FIG. 10 including wicking feature 1010. As illustrated in FIGS. 9 and 11, the contact angle, $\theta$, is formed between the ink 820, 1020 and the wicking surfaces of the sides 805, 1005 of the wicking feature 810, 1010.

The Concus-Finn condition determines whether or not liquid will wick in a corner feature based on the contact angle and the angle of the corner. The condition is stated as:

$$\beta=(\pi-\alpha)/2 \quad [1]$$

In this equation, $\beta$ is the critical contact angle required to achieve wicking, and $\alpha$ is the angle of the corner. Spontaneous capillary flow occurs when the contact angle, $\theta$, is less than $\beta$ which is the complementary angle to the angle of the corner. For ink, the contact angle is roughly 5-10 degrees, and for the various cross sectional shapes for wicking features illustrated in FIGS. 8-19, $\beta$ is between about 15 to about 45 degrees, thus wicking should occur in wicking features having these cross sectional shapes or other cross sectional shapes with $\beta$ that is less than the ink contact angle. According to the Concus-Finn condition, for a triangular separator element, the contact angle is less than 30 degrees and is less than 45 degrees for a square.

The wicking features will generally not have geometrically perfect corners. These imperfections may be considered in the design of the wicking features. For example, studies have shown that a finite curvature in the corner (see FIG. 11) may increase the critical angle by as much as 30%.

Figure 12:
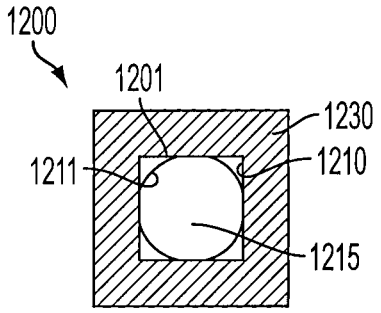

FIGS. 12-19 depict additional cross sectional diagrams of exemplary configurations of a separator element. For example, as shown in FIG. 12 the separator element 1200 comprises a separator feature 1201 surrounded by a boundary 1230. The boundary 1230 may comprise any suitable solid material, such as metal or plastic. In this case, the boundary 1230 defines a square feature 1201, which includes four wicking features 1210 formed by the corner regions 1220 of the separator feature 1201. The wicking features 1210 are dimensioned to preferentially wick the ink 1211 and to substantially exclude vapor bubbles. The vapor from the bubbles is separated from the ink 1211 at the surfaces of the wicking features 1210 and flows through the vapor region 1215 near the center of the separator feature 1201.

Figure 13:
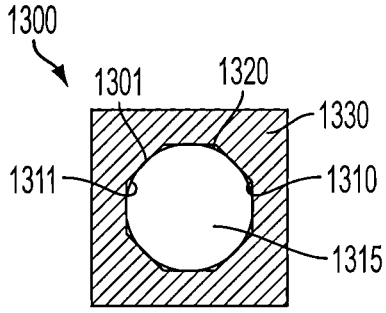
Figure 14:
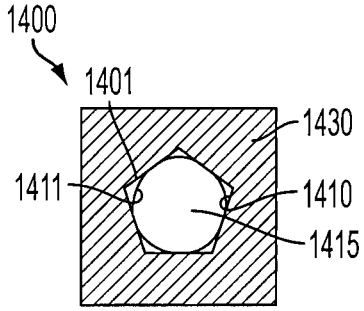
Figure 15:
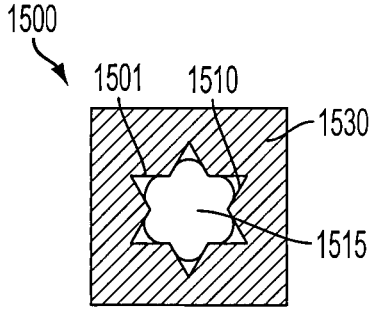

FIGS. 13-15 illustrate separator elements 1300, 1400, 1500 having separator features 1301, 1401, 1501 formed in variety of geometrical shapes, such as a pentagon (FIG. 13), hexagon (FIG. 14), star (FIG. 15). The feature 1301, 1401, 1501 is defined by a boundary 1330, 1430, 1530. The geometrical feature 1301, 1401, 1501 includes wicking features 1310, 1410, 1510 formed by the corners of the feature 1301, 1401, 1501. The wicking features 1310, 1410, 1510 are dimensioned to preferentially wick the ink 1311, 1411, 1511 and to substantially exclude vapor bubbles from entering the wicking features 1310, 1410, 1510. The vapor from the bubbles is separated from the ink 1311, 1411, 1511 at the wicking features 1310, 1410, 1510 and flows through the vapor region 1315, 1415, 1515 near the center of the separator feature 1301, 1401, 1501.

Figure 16:
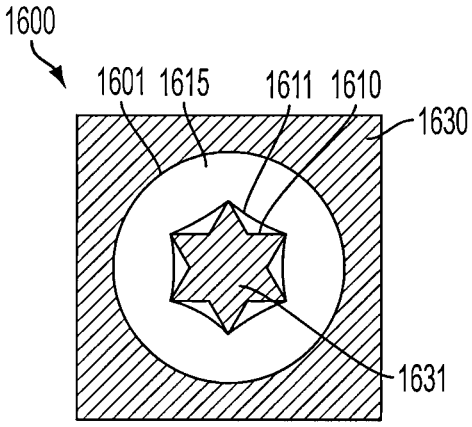
Figure 17:
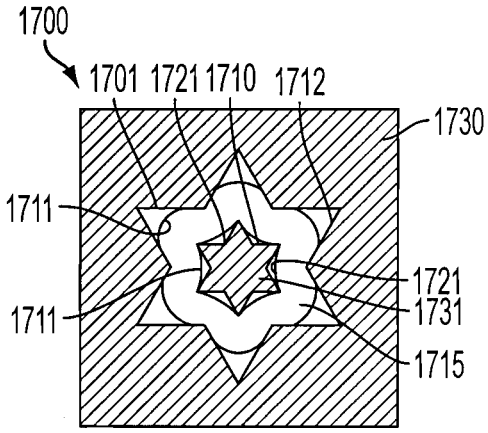
Figure 18:
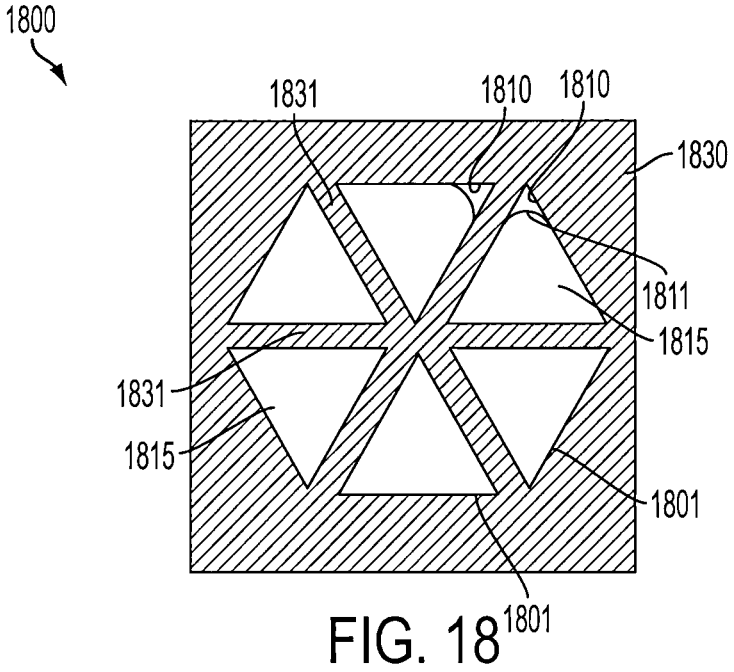
Figure 19:
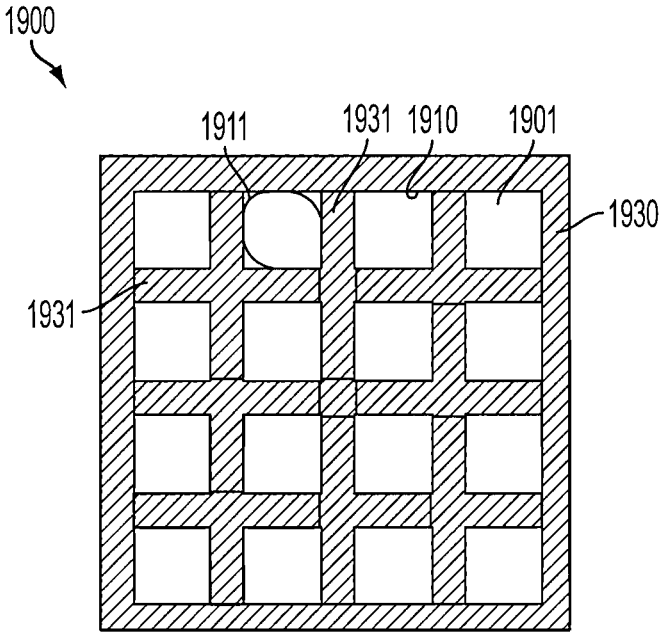

According to some implementations, the separator feature may be formed between inner and outer boundaries as illustrated by FIGS. 16 and 17. FIG. 16 shows a cross sectional view of separator element 1600 that includes a separator feature 1601 formed between an outer boundary 1630 and an inner boundary 1631. In this case, the outer boundary 1630 is circular and the inner boundary 1631 has the shape of a star. The wicking features 1610 are formed by the corners of the inner boundary 1631. The wicking features 1610 are dimensioned to preferentially wick the ink 1611 and to substantially exclude vapor bubbles from entering the wicking features 1610. The vapor from the bubbles is separated from the ink 1611 at the wicking features 1610 and flows through the vapor region 1615 of the separator feature 1601.

In some cases, both the inner and outer boundaries may include wicking features as illustrated in FIG. 17. FIG. 17 shows an example of a separator element 1700 that includes star-shaped inner and outer boundaries 1731, 1730 that define a separator feature 1701. The feature 1701 includes wicking features 1710, 1712 in the corners of the inner and outer boundaries 1731, 1730. The wicking features 1710, 1712 are dimensioned to preferentially wick the ink 1711 and to substantially exclude vapor bubbles from flowing in the wicking features 1710, 1712. The vapor from the bubbles is separated from the ink 1711 at the wicking features 1710, 1712 and flows through the vapor region 1715 of the separator feature 1701.

In some cases, the separator element can includes multiple inner boundaries that define multiple channels with wicking features. Increasing the density of wicking features may be useful to increase ink flow. A few possibilities for separator element configurations that include multiple separator features 1801, 1901 are illustrated by separator elements 1800, 1900 of FIGS. 18 and 19, although many other configurations are possible. The inner 1831, 1931 and outer 1830, 1930 boundaries may be arranged to define multiple separator features 1801, 1901 of any appropriate configuration arranged in any pattern, such as an array or circular pattern. The corners of the inner and outer boundaries 1831, 1931, 1830, 1930 form multiple wicking features 1810, 1910. The wicking features 1810, 1910 are dimensioned to allow ink 1811, 1911 to flow in the wicking features 1810, 1910 and to substantially exclude the vapor bubbles. The vapor from the bubbles moves through the vapor passages 1815, 1915 of the separator features 1801, 1901.

Figure 20:
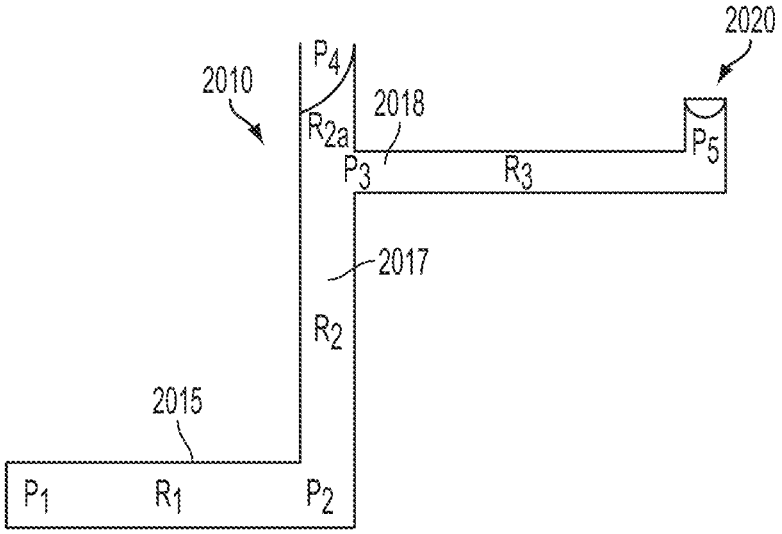
FIG. 20 provides model representation of a bubble separator and ink jet.

The flow of ink and vapor within a bubble separator, e.g., the bubble separator of FIG. 6, can be analyzed using a 1-dimensional lumped model. A simplified representation of a bubble separator 2010 and inkjet 2020 is illustrated by the diagram of FIG. 20. As illustrated in FIG. 20, the separator element 2010 includes the inlet 2015 which is connected to an ink reservoir (not shown), a wicking feature 2017, an ink outlet 2018 which is fluidically coupled to the ink jet 2020.

Figure 21:
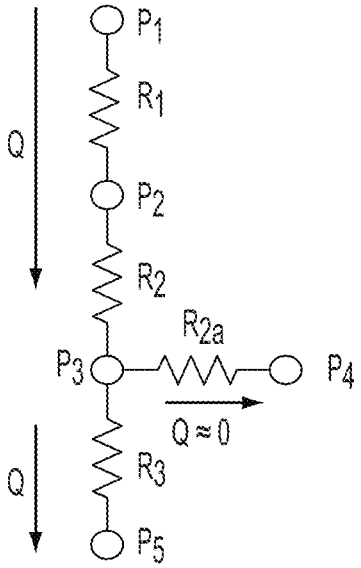
FIG. 21 is a circuit representation of the bubble separator and ink jet of FIG. 20.

The diagrams of FIGS. 20 and 21 are useful to analyze the pressures and hydrodynamic resistances within the ink jet printer. The reservoir is assumed to be at atmospheric pressure. Illustrated at the top of the wicking feature 2017 in FIG. 20 is the separator free surface. Free surfaces generate a suction pressure equal to $2\sigma/r$, where r is radius of curvature and $\sigma$ is the surface tension. The flow of the ink within the separator 2010 is Q which is equal to $\Delta P/R$, where R is the hydrodynamic resistance, Q is the volume flow, and $\Delta P$ is the pressure drop. The separator 2010 has a non-zero flow so that ink flows in the ink outlet 2018 to the ink jet 2020. The hydrodynamic resistive losses in the passages and along the wicking features and the relative pressures in the system are selected to achieve the non-zero flow condition. The circuit of FIG. 21 represents the simplified bubble separator diagram of FIG. 20. Each node of the circuit represents a junction of the bubble separator and each resistor of the circuit represents the hydrodynamic resistance of a passage. FIG. 20 shows the location of the pressures and hydrodynamic resistances that correspond to the pressures and hydrodynamic resistances of the circuit model in FIG. 21. P1 is the pressure of the ink reservoir, P2 is the pressure at the junction at the inlet of the separator element, P3 is the pressure at the junction between the ink outlet and the separator element, P4 is the pressure at the free surface of the separator element, and P5 is the pressure at the ink jet aperture. In FIGS. 20 and 21, R1 is the hydrodynamic resistance of the inlet, R2 is the hydrodynamic resistance of the wicking feature, R2*a* is the hydrodynamic resistance of the wicking feature above the junction between the ink outlet and the separator element, R3 is the hydrodynamic resistance of the ink outlet. The criterion for non-zero flow rate is:

$$P1>P2>P3\approx P4>P5 \quad [2]$$

The design of the separator balances the ink above the junction between the separator element and the ink outlet (P3) so that there is minimal net flow of ink through the vapor outlet. The balancing is achieved when there is equilibrium between the pressure at the ink outlet (P3) and the pressure at the free surface of the separator element (P4). When this equilibrium is achieved, P3≈P4 and active pumping of ink into the region beyond the outlet junction is reduced.

If P4<P5, the separator will deprime the ink jet. This condition can occur if the radius of curvature of the separator free surface, $R_s$ is less than the jet orifice diameter. Because capillary pressure changes with 1/r, the separator element must have a small enough radius of curvature so that the flow from the jet aperture does not deprime the separator. According to this constraint, the separator element at the wicking feature should have a radius of curvature of about the same order of magnitude as the ink jet orifice and no more than about 1-2 orders of magnitude less than the ink jet orifice.

Resistances in each section should be low enough so that the volumetric flow (Q) remains sufficiently high in the separator for the specified pressure drop between P5 and P1. Hydrodynamic resistance formulas for arbitrary channel shapes are available, e.g. for a circular channel: $R=\pi r_t^2/8\,\mu L$, where $r_t$ is the tube radius, L is the tube length, and $\mu$ is the dynamic viscosity of the ink. For a representative jet radius of 50 microns with an ink having surface tension of 0.025 Pa-s, the capillary driving pressure, P5, (which is a suction) is 2*0.025/50e−6=1e4 Pa. The resistance of most flow channels is not significant compared to the suction pressure due to the jet meniscus for channel lengths on the order of millimeters and hydraulic diameters on the order of tenths of millimeters. Using the aforementioned circular tube of radius $r_t$. the hydrodynamic resistance (R3) of the channel does not exceed the capillary driving pressure P5 until the channel is 1.5 mm long; in typical print heads these channels are usually a factor of 10 shorter.

Appropriate dimensioning of the inlet can prevent the bubbles from depriming the separator. Except for the case of bubbles that have no solid-liquid-gas contact line which could occur for an aggressively wetting ink with a contact angle approaching zero, the free surface of a bubble can interfere with the pressure balance in the separator. To reduce the possibility that a bubble will act to deprime the separator, the inlet should have a radius of curvature greater than the radius of curvature of the wick or the ink jet. For example, this dimensioning may be achieved for an inlet with a rectangular cross section if the narrow dimension of the rectangle is larger than the radius of curvature of the wicking feature in the separator element. The upper bound on this critical size of the inlet channel is controlled by the size of the print head features, e.g., typically less than about 1 mm.

The resistance to flow in the wick itself (R2) should be small to ensure proper transport of ink through the separator. Research in the micro-heat pipe area has demonstrated that the hydrodynamic resistance of a wick is comparable to a pipe with a similar hydraulic diameter. That is, for a wick with a radius of curvature of 100 microns, the resistance is of the order of that of a circular pipe with radius 100 microns. Thus, using these types of wicking features should both prevent vapor intrusion into the ink flow path and provide a liquid conduit for the ink with modest hydrodynamic resistance. Depending on the design, the cross sectional area of the ink flow in the wicking feature may less than about 10 $\mu m^2$, with mass flow less than about 1 mg/s. A number of separators may be used in parallel to provide sufficient flow rate to a bank of ink jets. Alternatively, one or more separators, and one or more vapor vents, may be used for each ink jet.

Figure 22:
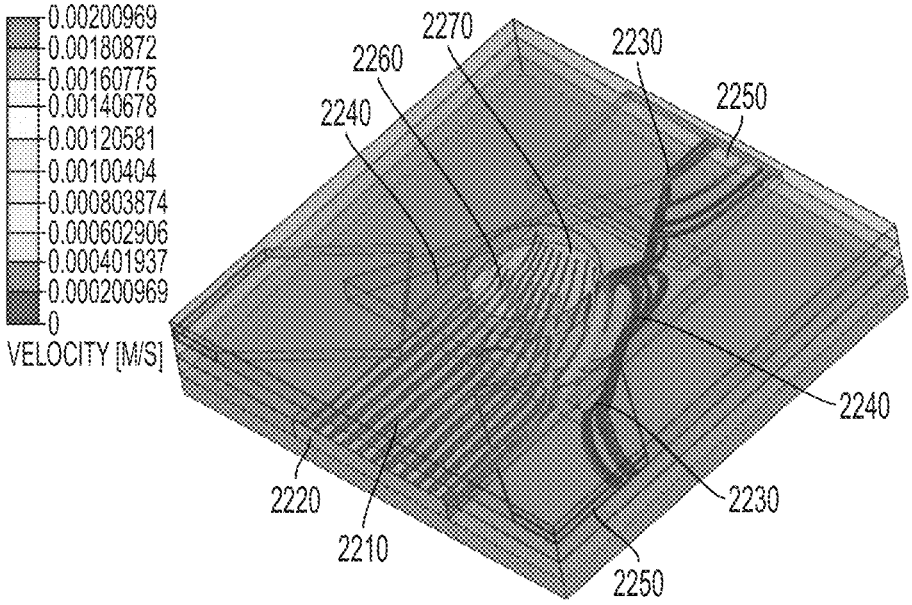
FIGS. 22 and 23 are isometric and side views, respectively of a bubble separator showing the result of modeling ink and vapor flow paths.
Figure 23:
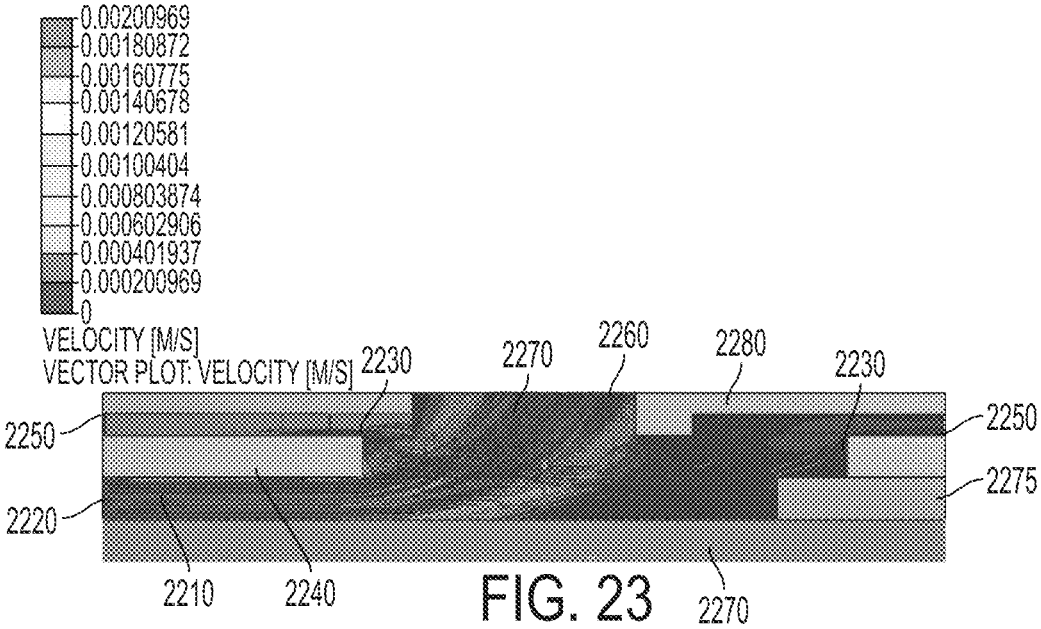

FIG. 22 is an isometric view and FIG. 23 is a side view of the bubble separator previously illustrated in FIG. 6 that shows the result of modeling ink and vapor flow paths. The flow lines show the ink with vapor bubbles 2210 that enters through the inlet 2220 of the bubble separator. The ink flow path travels along two of the wicking features 2230 formed by the corners of the triangular-shaped separator element 2240 and exits the bubble separator through the ink outlets 2250. The vapor 2260 flows through the vapor outlet 2270 in the center region of the separator element 2240.

Figure 24:
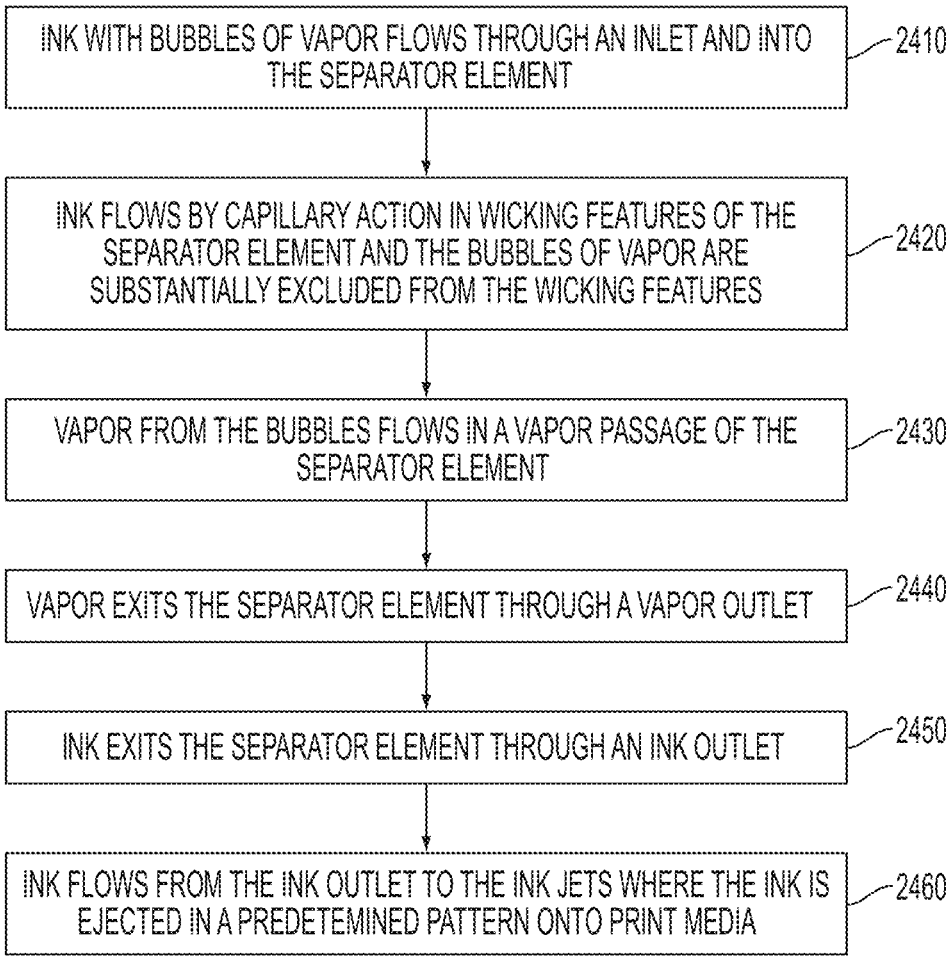
FIG. 24 is a flow diagram illustrating a process of separating ink from bubbles of vapor.

FIG. 24 is a flow diagram illustrating a process of separating ink from vapor Ink that includes bubbles of vapor flows 2410 through an inlet of the separator device. Within the separator element of the bubble separator, the ink flows 2420 by capillary action in one or more wicking features. The wicking features are dimensioned so that the bubbles of vapor are substantially excluded from flowing in the wicking features. The ink is separated from the vapor at the wicking features. Vapor from the bubbles flows 2430 in a vapor outlet of the separator element. The vapor exits 2440 the separator element through a vapor outlet. The ink exits 2450 the separator element through an ink outlet passage and flows 2460 from the ink outlet passage to the ink jets. The ink exiting the separator element includes fewer bubbles that the ink entering the separator element. The ink is ejected from the ink jets in a predetermined pattern onto print media.

The bubble separator may be formed as a layered structure, as best illustrated by the cross sectional diagram of FIG. 23. In this example, there are four layers in the device: a solid base layer 2270, an inlet layer 2275, a separator layer 2240, and an outlet layer 2240. The inlet layer 2275 and the base layer 2270 form the inlet 2210 that allows the ink that includes the bubbles of vapor to enter the separator element 2200. Although the separator layer can be designed ensure clean liquid output in the case of lower volume fraction vapor-liquid input flows that do not contain alternating "slugs" of vapor and liquid (i.e. the bubbles fully occupy the inlet channel), the vapor output 2270 may contain some amount of liquid ink in this case. The separator layer 2240 forms an equilateral triangle in this particular realization, but, as previously discussed, any shape that creates a wicking structure on the edges would be suitable. The choice of dimensions is a function of the ink properties, manufacturing capabilities and tolerances, expected volume fraction of air and design requirements for the ink removal channels.

The outlet layer 2240 forms the vapor outlet 2270 that can be connected to other structures in additional layers. The outlet layer 2240 also forms the three liquid ink outlets 2250 that may be about half the thickness of the inlet layer 2275 to facilitate the use of both capillary pressure control and resistance management to ensure that bubbles do not exit through the ink outlets 2250. By using narrow ink outlets 2250 the resistance is increased over the vapor outlet 2270 such that bubbles will take the path of lower resistance, which is the vapor outlet 2270. Additionally if the ink outlet 2250 is on the order of 10 microns, the capillary pressure penalty for vapor intrusion into the ink outlet 2250 will be on the order of the meniscus back pressure and it is unlikely that the vapor will penetrate the ink outlets 2250. Precise alignment of the ink outlets 2250 with the wicking features 2230 is not critical for liquid removal; for example a +/−25 micron shift of the ink outlets still allows for overlap of the ink outlets 2250 and the corners of the separator element 2240. The separator can be designed using combinations of separator geometries, expected filling ratios and ink outlet passage configurations to provide maximum robustness to manufacturing.

The vapor outlet 2270 and the wicking features 2230 may both be relatively large with respect to a multi-layered jet stack, for example, depending on the ratio of vapor to liquid.

Figure 26:
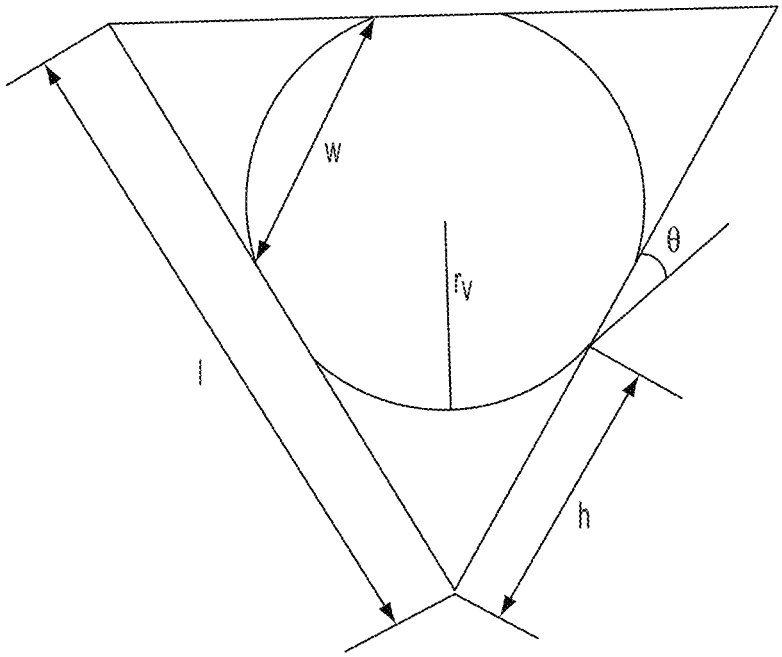
FIG. 26 illustrates the relative dimensions of a bubble separator having a triangular separator feature.

Assuming each side of the separator triangle, l, is about 240 microns long, a vapor outlet of radius, $r_v$, of 70 microns and a contact angle, θ, of 5 degrees, the height of the wetted area in each of the corners has a height h (see FIG. 26) of about 45 microns and width, w, of the wetted area at the meniscus of about 115 microns. These areas are large enough to allow for manufacturing tolerances associated with multilayer print head construction methods.

Figure 25:
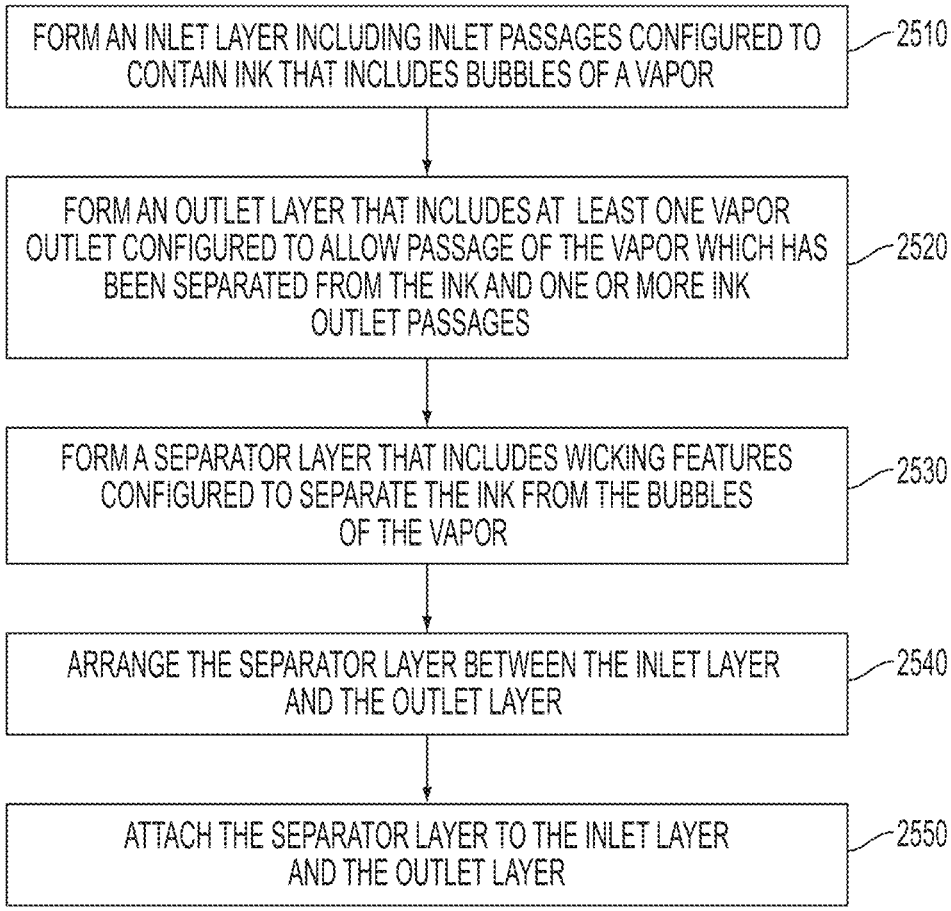
FIG. 25 is a flow diagram illustrating a process for manufacturing a layered bubble separator.

FIG. 25 depicts a flow diagram of a process for manufacturing a bubble separator. An inlet layer is formed 2510 that includes one or more inlet passages configured to allow passage of ink that contains bubbles of a vapor through the inlet passages. An outlet layer is formed 2520, the outlet layer including at least one vapor outlet and one or more ink outlets. The vapor outlet is configured to allow passage of the vapor that has been separated form the ink. The ink outlet is configured to allow passage of the ink. A separator layer is formed 2530, the separator layer including wicking features that separate the ink from the bubbles of the vapor. The wicking features are dimensioned to allow the ink to move in the wicking features through capillary action while substantially excluding the bubbles from entering the wicking features. The separator layer is arranged 2540 between the inlet layer and the outlet layer. The inlet and outlet layers are attached 2550 to the separator layer. The inlet layer, outlet layer and/or separator layer can be fabricated using any methods for fabrication of cuts or channels in thin substrates such as chemical or ion etching, micromachining, punching, molding, etc. The layers may be-attached by any suitable method including laminating or bonding and/or by using any combination of methods including adhesives, plasma or diffusion bonding, chemical reaction, welding, etc.

Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

Various modifications and additions can be made to the preferred embodiments discussed above. Accordingly, the scope of the present invention should not be limited by the particular embodiments described above, but should be defined only by the claims set forth below and equivalents thereof.

What is claimed is:

1. An ink jet print head subassembly, comprising:

one or more separator elements configured to separate bubbles of a vapor from ink, each separator element comprising wicking features having one or more of corners and/or angled surfaces with dimensions sufficient to allow capillary movement of the ink in the wicking features and to substantially exclude the bubbles of the vapor from the wicking features;

one or more inlets configured to allow passage of the ink that includes the bubbles of the vapor into the separator element;

at least one vapor outlet configured to allow the vapor that has been separated from the ink to exit from the separator element; and one or more ink outlets configured to allow the ink to exit from the separator element.

2. The subassembly of claim 1, wherein each ink outlet dimensioned so that a pressure gradient required for entry of the bubbles into the ink outlet is greater than a pressure gradient required for entry of the bubbles into the vapor outlet.

3. The subassembly of claim 1, wherein the wicking features have a radius of curvature about an order of magnitude less than a radius of curvature of an ink jet.

4. The subassembly of claim 1, wherein the inlet has a radius of curvature greater than a radius of curvature of the wicking features.

5. The subassembly of claim 1, wherein the separator element includes a vapor region configured to allow movement of the vapor within the separator element, and, the ink moves primarily in the wicking features of the separator element to the ink outlets and the vapor moves primarily in the vapor region to the vapor outlet.

6. The subassembly of claim 5, wherein the separator element has a triangular shape and corners of the triangular shape form the wicking features and a center portion of the triangular shape forms the vapor passage.

7. The subassembly of claim 5, wherein the separator element has a star shape and corners of the star form the wicking features and a center portion of the star forms the vapor passage.

8. The subassembly of claim 1, wherein each of the wicking features comprises at least one angle of less than about 45 degrees.

9. The subassembly of claim 1, wherein the vapor outlet and the ink outlets are dimensioned to provide a path of least resistance for the vapor.

10. The subassembly of claim 1, comprising:

an inlet layer that includes the inlet;

an outlet layer that includes the vapor outlet and the ink outlets; and a separator layer that includes the separator element, the separator layer disposed between the inlet layer and the outlet layer.

11. The subassembly of claim 1, comprising multiple separator elements, each separator element fluidically coupled to corresponding inlet passages, ink outlet passages and vapor passages.

12. A method, comprising:

moving ink that includes bubbles of a vapor into a separator element of an ink jet print head, the separator element including a central region and wicking features having one or more of corners and/or angled surfaces;

separating the ink from the bubbles of vapor in the separator element, wherein separating the ink includes moving the ink in the wicking features by capillary action, wherein the bubbles are substantially excluded from the wicking features;

passing the vapor through the central portion of the separator element towards a vapor outlet;

moving the ink from the separator element to ink jets of an ink jet print head, wherein the ink that exits the separator element to the ink jets includes fewer bubbles of the vapor than the ink that enters the separator element; and ejecting the ink from the ink jets onto print media.

13. The method of claim 12, wherein separating the ink from the bubbles of vapor depends on pressures within the separator element which are sufficient to allow the ink to enter ink outlets and to substantially prevent the ink from entering the vapor outlet.

14. The method of claim 13, wherein separating the ink from the bubbles of vapor depends on hydrodynamic resistances within the separator element which are sufficient to prevent the bubbles from entering the wicking features and to allow the bubbles to enter the vapor outlet.

15. A layered structure, comprising:

an inlet layer configured to form inlets for ink that includes bubbles of a vapor;

an outlet layer configured to form a vapor outlet that allows passage of the vapor which has been separated from the ink and to form one or more ink outlets that allow passage of ink; and a separator layer disposed between the inlet layer and the outlet layer, the separator layer comprising a separator element that includes wicking features configured to separate the ink from the bubbles of the vapor, the wicking features having one or more of corners and/or angled surfaces dimensioned to allow entry of the ink into the wicking features and to transport the ink through capillary action and to substantially exclude the bubbles from the wicking features.

16. The layered structure of claim 15, wherein the wicking features have a radius of curvature about an order of magnitude less than a radius of curvature of an ink jet.

17. The layered structure of claim 15, wherein the inlet has a radius of curvature greater than a radius of curvature of the wicking features.

18. The subassembly of claim 15, wherein the separator element includes a vapor region configured to allow movement of the vapor within the separator element, and, the ink moves primarily in the wicking features of the separator element to the ink outlets and the vapor moves primarily in the vapor region to the vapor outlet.

19. The subassembly of claim 15, wherein the separator element has a triangular or star shape and corners of the triangular or star shape form the wicking features and a center portion of the triangular or star shape forms the vapor passage.

20. A method, comprising:

forming an inlet layer, the inlet layer including at least one inlet configured to contain ink that includes bubbles of a vapor;

forming an outlet layer that includes at least one vapor outlet configured to allow passage of the vapor which has been separated from the ink and one or more ink outlets;

forming a separator layer disposed between the inlet layer and the outlet layer, the separator layer comprising a separator element that includes wicking features configured to separate the ink from the bubbles of the vapor, the wicking features having one or more of corners and/or angled surfaces dimensioned to allow entry of the ink into the wicking features and to transport the ink through capillary action and to substantially exclude the bubbles from the wicking features; and attaching the separator layer between the inlet layer and the outlet layer.

21. The method of claim 20, wherein forming one or more of the inlet layer, outlet layer and separator layer comprises one or more of chemical etching, laser cutting, punching, machining, and printing.

22. The method of claim 20, wherein attaching the separator layer between the inlet layer and the outlet layer comprises one or more of diffusion bonding, plasma bonding, adhesives, welding, chemical bonding, and mechanical joining.

23. An ink jet printer, comprising:

a print head comprising jets configured to selectively eject ink toward a print medium according to predetermined pattern;

a transport mechanism configured to provide relative movement between the print medium and the print head;

a bubble separator configured to separate bubbles of vapor from the ink before the ink enters the jets, the bubble separator including:

a separator element comprising wicking features having one or more of corners and/or angled surfaces with dimensions sufficient to allow capillary movement of the ink in the wicking features and to substantially exclude the bubbles of the vapor from the wicking features;

one or more inlet passages configured to allow passage of the ink that includes the bubbles of the vapor into the separator element;

at least one vapor outlet passage configured to allow exit of the vapor that has been separated from the ink from the separator element; and one or more ink outlet passages configured to allow the ink to exit from the separator element.

24. The printer of claim 23, wherein:

the wicking features have a radius of curvature about an order of magnitude less than a radius of curvature of an ink jet;

the inlet has a radius of curvature greater than a radius of curvature of the wicking features; and the separator element includes a vapor region configured to allow movement of the vapor within the separator element, wherein the ink moves primarily in the wicking features of the separator element to the ink outlets and the vapor moves primarily in the vapor region to the vapor outlet.

25. An ink jet print head subassembly, comprising:

means for separating bubbles of a vapor from an ink with wicking features having one or more of corners and/or angled surfaces with dimensions sufficient to allow capillary movement of the ink in the wicking features and to substantially exclude the bubbles of the vapor from the wicking features;

one or more inlet passages configured to allow passage of the ink that includes the bubbles of the vapor into the means for separating;

at least one vapor outlet passage configured to allow the vapor that has been separated from the ink to exit from the means for separating; and one or more ink outlet passages configured to allow the ink to exit from the means for separating.

* * * * *